US012696922B2

(12) United States Patent
Ajithkumar et al.

(10) Patent No.: US 12,696,922 B2
(45) **Date of Patent: *Aug. 4, 2026**

(54) HEATED AEROSOL-GENERATING ARTICLE COMPRISING HOMOGENISED BOTANICAL MATERIAL

(71) Applicant: Philip Morris Products S.A., Neuchatel (CH)

(72) Inventors: Anu Ajithkumar, Neuchatel (CH); Corinne Deforel, Formangueires (CH); Gerhard Lang, Murten (CH)

(73) Assignee: Philip Morris Products S.A., Neuchatel (CH)

( * ) Notice: Subject to any disclaimer, the term of this patent is extended or adjusted under 35 U.S.C. 154(b) by 147 days.

This patent is subject to a terminal disclaimer.

(21) Appl. No.: 16/603,379

(22) PCT Filed: May 22, 2018

(86) PCT No.: PCT/EP2018/063405

§ 371 (c)(1),
(2) Date: Oct. 7, 2019

(87) PCT Pub. No.: WO2018/215481

PCT Pub. Date: Nov. 29, 2018

(65) Prior Publication Data

US 2020/0054064 A1 Feb. 20, 2020

(30) Foreign Application Priority Data

May 24, 2017 (EP) ..... 17172906

(51) Int. Cl.

| | |
|---|---|
| ***A24B 15/14*** | (2006.01) |
| ***A24B 3/14*** | (2006.01) |
| ***A24B 15/16*** | (2020.01) |
| ***A24B 15/28*** | (2006.01) |
| ***A24B 15/42*** | (2006.01) |
| ***A24D 3/06*** | (2006.01) |

(52) U.S. Cl.
CPC ..... *A24B 15/14* (2013.01); *A24B 15/165* (2013.01); *A24B 3/14* (2013.01); *A24B 15/287* (2013.01); *A24B 15/42* (2013.01); *A24D 3/063* (2013.01)

(58) Field of Classification Search
CPC ..... A24B 15/14; A24B 15/165; A24B 3/14; A24B 15/287
See application file for complete search history.

(56) References Cited

U.S. PATENT DOCUMENTS

| | | | | |
|---|---|---|---|---|
| 3,499,454 | A | 3/1970 | Hind | |
| 3,860,012 | A | 1/1975 | Selke | |
| 3,894,544 | A | 7/1975 | Egri | |
| 5,099,864 | A | 3/1992 | Young et al. | |
| 5,415,186 | A | 5/1995 | Casey, III et al. | |
| 5,724,998 | A | 3/1998 | Gellatly et al. | |
| 2004/0255965 | A1* | 12/2004 | Perfetti | A24B 15/308 131/352 |
| 2010/0275936 | A1* | 11/2010 | Bivehed | A24B 15/18 131/352 |
| 2014/0109922 | A1* | 4/2014 | Gedevanishvili | A24B 15/285 131/334 |
| 2016/0100625 | A1 | 4/2016 | Mua et al. | |
| 2016/0205992 | A1* | 7/2016 | Bell | A24B 15/16 |
| 2018/0049465 | A1 | 2/2018 | Ajithkumar et al. | |

FOREIGN PATENT DOCUMENTS

| | | | |
|---|---|---|---|
| CH | 691 156 | A5 | 5/2001 |
| CN | 1994159 | A | 7/2007 |
| CN | 103561593 | A | 2/2014 |
| CN | 104013603 | A | 9/2014 |
| CN | 104957750 | A * | 10/2015 |
| CN | 105555153 | A | 5/2016 |
| CN | 105722415 | A | 6/2016 |
| CN | 106136305 | A | 11/2016 |
| CN | 106686992 | A | 5/2017 |
| GB | 983928 | A | 2/1965 |
| JP | 2016-527913 | | 9/2016 |
| RU | 2 256 386 | C2 | 7/2005 |
| RU | 2 596 444 | C2 | 9/2016 |
| WO | WO 96/32854 | A2 | 10/1996 |
| WO | WO 2009/022232 | A2 | 2/2009 |
| WO | WO 2012/164009 | A2 | 12/2012 |
| WO | WO 2013/178767 | A1 | 12/2013 |
| WO | WO 2014/125251 | A1 | 8/2014 |

(Continued)

OTHER PUBLICATIONS

Machine translation of CN104013603A (Year: 2021).*
https://www.merriam-webster.com/dictionary/agglomerate (Year: 2022).*
Pankow, James F., et al., "Conversion of Nicotine in Tobacco Smoke to Its Volatile and Available Free-Base Form through the Action of Gaseous Ammonia", 1997, American Chemical Society, Environmental Science & Technology, doi: 10.1021/es970402f https://pubs.acs.org/doi/10.1021/es970402f# (Year: 1997).*
Combined Chinese Office Action and Search Report issued Jul. 26, 2021 in corresponding Chinese Patent Application No. 201880028347.3 (with English Translation and English Translation of Category of Cited Documents), 18 pages.

(Continued)

*Primary Examiner* — Michael J Felton
(74) *Attorney, Agent, or Firm* — Oblon, McClelland, Maier & Neustadt, L.L.P.

(57) ABSTRACT

A heated aerosol-generating article is provided, including an aerosol-generating substrate, the aerosol-generating substrate including a homogenised botanical material comprising particulate plant material, an aerosol former, and a basic pH modifier; and the homogenised botanical material has a particulate plant material content of greater than or equal to about 60% by weight on a dry weight basis and less than or equal to about 90% by weight on a dry weight basis; and the homogenised botanical material has a pH greater than or equal to about 6.0 and less than or equal to about 8.0.

12 Claims, No Drawings

(56) References Cited

FOREIGN PATENT DOCUMENTS

| | | | | | |
|---|---|---|---|---|---|
| WO | WO-2015082648 | A1 * | 6/2015 | ..... | A24F 40/20 |
| WO | WO 2016/156598 | A1 | 10/2016 | | |
| WO | WO 2016/184977 | A1 | 11/2016 | | |
| WO | WO 2017/077110 | A1 | 5/2017 | | |
| WO | WO 2017/077112 | A1 | 5/2017 | | |
| WO | WO 2018/215479 | A1 | 11/2018 | | |

OTHER PUBLICATIONS

International Search Report and Written Opinion issued Aug. 10, 2018 in PCT/EP2018/063405 filed May 22, 2018.
Extended European Search Report issued on Nov. 8, 2017, in Patent Application No. 17172906.4, 8 pages.
Combined Office Action and Search Report issued Sep. 9, 2021 in corresponding Russian Patent Application No. 2019136368/03(071757) (with English Translation), 12 pages.
Office Action issued Jun. 22, 2022, in Japanese Patent Application No. 2019-563093 w/English-language Translation.
Chinese Office Action and Chinese Search Report mailed on Apr. 15, 2023 in Chinese Patent Application No. 201880028347.3 filed on May 22, 2018, with English translation, total 17 pages.

* cited by examiner

HEATED AEROSOL-GENERATING ARTICLE COMPRISING HOMOGENISED BOTANICAL MATERIAL

The present invention relates to heated aerosol-generating articles comprising aerosol-generating substrates comprising homogenised botanical material. In particular, the present invention relates to heated aerosol-generating articles comprising aerosol-generating substrates comprising gathered cast sheets of homogenised botanical material.

Homogenised tobacco material is frequently used in the production of tobacco products. Such homogenised tobacco material is typically manufactured from parts of the tobacco plant that are less suited for the production of cut filler, like, for example, tobacco stems or tobacco dust.

A number of reconstitution processes for producing homogenised tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB 983,928 A.

Known casting or 'cast leaf' processes typically comprise the steps of: combining particulate tobacco and a binder to form a slurry; casting the slurry onto a support surface; drying the cast slurry to form a sheet of homogenised tobacco material and removing the sheet of homogenised tobacco material from the support surface. The sheet of homogenised tobacco material may be cut or shredded prior to being used in the production of tobacco products.

Nicotine may be partially lost during production of homogenised tobacco materials using such known reconstitution processes. In particular, nicotine may be lost during drying of homogenised tobacco materials produced using such known reconstitution processes. For example, in known casting or 'cast leaf' processes, nicotine may be lost during the step of drying the cast slurry to form a sheet of homogenised tobacco material.

WO 2012/164009 A2 discloses rods comprising gathered cast sheets of homogenised tobacco material for use as aerosol-generating substrates in heated aerosol-generating articles.

In heated aerosol-generating articles comprising an aerosol-generating substrate, an inhalable aerosol is formed by heating the aerosol-generating substrate to a relatively low temperature, for example a temperature of about 350° C. In order for a satisfactory aerosol to be generated upon heating the aerosol-generating substrate to such a relatively low temperature, homogenised botanical materials for use in aerosol-generating substrates in heated aerosol-generating articles typically have a relatively high aerosol former content.

Aerosol-generating substrates in heated aerosol-generating articles are typically significantly shorter in length than rods of combustible tobacco material in conventional lit-end cigarettes. In order for a satisfactory aerosol to be generated upon heating, it is important to optimise the release of active substances from homogenised botanical materials in aerosol-generating substrates of short length in heated aerosol-generating articles.

It would be desirable to enhance the release of active substances from homogenised botanical materials upon heating. In particular, it would be desirable to increase the transfer yield of active substance to an inhalable aerosol produced by heating an aerosol-generating substrate comprising homogenised botanical material in a heated aerosol-generating article, wherein the transfer yield of active substance is defined as (amount of active substance delivered in the aerosol upon heating)/(amount of active substance in the homogenised botanical material in the aerosol-generating substrate of the aerosol-generating article before heating).

It would be particularly desirable to enhance the release of nicotine from homogenised tobacco material upon heating. In particular, it would be desirable to increase the transfer yield of nicotine to an inhalable aerosol produced by heating an aerosol-generating substrate comprising homogenised tobacco material in a heated aerosol-generating article, wherein the transfer yield of nicotine is defined as (amount of nicotine delivered in the aerosol upon heating)/(amount of nicotine in the homogenised tobacco material in the aerosol-generating substrate of the aerosol-generating article before heating).

Upon heating of homogenised tobacco material, nicotine migrates from within the homogenised tobacco material to the surface thereof in order to be released. Migration of nicotine within homogenised tobacco material is limited by diffusion. Therefore, one way to enhance the release of nicotine would be to increase the temperature to which the homogenised tobacco material is heated, thereby improving diffusion. However, this may disadvantageously result in the formation and evolution of potentially undesirable compounds. Increasing the temperature to which an aerosol-generating substrate comprising homogenised tobacco material in a heated aerosol-generating article is heated may also adversely affect physical properties of the generated aerosol, for example the temperature of the aerosol or droplet or particle size of the aerosol.

Therefore, it would be desirable to enhance the release of nicotine from homogenised tobacco material upon heating to a relatively low temperature. In particular, it would be desirable to increase the transfer yield of nicotine to an inhalable aerosol produced by heating an aerosol-generating substrate comprising homogenised tobacco material in a heated aerosol-generating article to a relatively low temperature.

It would also be desirable to enhance the release of active substances from other homogenised botanical materials upon heating to a relatively low temperature.

According to the invention there is provided a heated aerosol-generating article comprising an aerosol-generating substrate, the aerosol-generating substrate comprising a homogenised botanical material comprising plant material, an aerosol former and a basic pH modifier, wherein the homogenised botanical material has a pH greater than or equal to about 5.5.

According to the invention there is provided a heated aerosol-generating article comprising an aerosol-generating substrate, the aerosol-generating substrate comprising a homogenised botanical material comprising plant material, an aerosol former and a basic pH modifier, wherein the homogenised botanical material comprises less than or equal to about 90% by weight of plant material and wherein the homogenised botanical material has a pH greater than or equal to about 5.5.

According to the invention there is also provided a heated aerosol-generating article comprising an aerosol-generating substrate, the aerosol-generating substrate comprising a homogenised botanical material comprising plant material, an aerosol former and a basic pH modifier, wherein the aerosol-generating substrate comprises greater than or equal to about 30% by weight of the homogenised botanical material and wherein the homogenised botanical material has a pH greater than or equal to about 5.5.

According to a preferred embodiment of the invention there is provided a heated aerosol-generating article comprising an aerosol-generating rod comprising a gathered sheet of homogenised botanical material comprising plant material, an aerosol former and a basic pH modifier circumscribed by a wrapper, wherein the homogenised botanical material has a plant material content of less than or equal to about 90% by weight on a dry weight basis and wherein the homogenised botanical material has a pH greater than or equal to about 5.5.

According to a particularly preferred embodiment of the invention there is provided a heated aerosol-generating article comprising an aerosol-generating rod comprising a gathered cast sheet of homogenised botanical material comprising plant material, an aerosol former and a basic pH modifier circumscribed by a wrapper, wherein the homogenised botanical material has a plant material content of less than or equal to about 90% by weight on a dry weight basis and wherein the homogenised tobacco material has a pH greater than or equal to about 5.5. Preferably, the homogenised botanical material is an alkaloid-containing material.

Preferably, the homogenised botanical material comprises alkaloid-containing plant material. As used herein with reference to the invention, the term "alkaloid-containing material" denotes a material that contains one or more alkaloids.

Alkaloids are a class of naturally occurring nitrogen-containing organic compounds. Alkaloids are found mostly in plants, but are also found in bacteria, fungi and animals.

Examples of alkaloids include, but are not limited to, caffeine, nicotine, theobromine, atropine and tubocurarine. A preferred alkaloid is nicotine, which may be found in tobacco.

Preferably, the homogenised botanical material is a homogenised tobacco material and the plant material is tobacco.

As used herein with reference to the invention, the term "heated aerosol-generating article" is intended to be synonymous with the terms "non-combustible aerosol-generating article" and "'heat-not-burn' aerosol-generating article" and denotes an aerosol-generating article comprising an aerosol-generating substrate that releases volatile compounds that can form an aerosol upon heating of the aerosol-generating substrate and without combustion of the aerosol-generating substrate.

As used herein with reference to the invention, the term "aerosol-generating substrate" denotes a substrate that is capable of releasing volatile compounds that can form an aerosol upon heating of the substrate.

As used herein with reference to the invention, the term "homogenised botanical material" denotes a material formed by agglomerating particulate plant material.

As used herein with reference to the invention, the term "homogenised tobacco material" denotes a material formed by agglomerating particulate tobacco.

As used herein with reference to the invention, the term "rod" is used to describe a generally cylindrical element of substantially circular, oval or elliptical cross-section.

As used herein with reference to the invention, the term "sheet" denotes a laminar element having a width and length substantially greater than the thickness thereof.

As used herein with reference to the invention, the term "gathered" denotes that the sheet is convoluted, folded, or otherwise compressed or constricted substantially transversely to the cylindrical axis of the rod.

Inclusion of a basic pH modifier in the homogenised botanical material increases the pH of the homogenised botanical material. Use of a homogenised tobacco material having a pH greater than or equal to about 5.5 advantageously enhances the release of nicotine from the homogenised tobacco material upon heating compared to a homogenised tobacco material that does not include a basic pH modifier. In particular, use of a homogenised tobacco having a pH greater than or equal to about 5.5 advantageously increases the transfer yield of nicotine to an inhalable aerosol produced by heating an aerosol-generating substrate comprising the homogenised tobacco material in a heated aerosol-generating article compared to a homogenised tobacco material that has a pH of less than 5.5.

Use of a homogenised botanical material comprising plant material, an aerosol former and a basic pH modifier wherein the homogenised tobacco material has a pH of greater than or equal to about 5.5 in an aerosol-generating substrate in a heated aerosol-generating article may thereby allow equivalent nicotine or aerosol yields to be obtained upon heating of the aerosol-generating substrate to a lower temperature compared to the use of a homogenised botanical material that has a pH of less than 5.5. This may provide a number of advantages. For example, heating the aerosol-generating substrate to a lower temperature may advantageously reduce the formation and evolution of potentially undesirable aerosol constituents from the homogenised botanical material. As a further example, where the heated aerosol-generating article is used in an electrically-operated aerosol-generating system, heating the aerosol-generating substrate to a lower temperature may advantageously allow for longer periods of operation of the electrically-operated aerosol-generating system without the need for recharging of a battery in the electrically-operated aerosol-generating system or may advantageously reduce the time required to recharge the battery in the electrically-operated aerosol-generating system. As yet a further example, where the heated aerosol-generating article is used in an electrically-operated aerosol-generating system, heating the aerosol-generating substrate to a lower temperature may advantageously allow for use of a smaller battery in the electrically-operated aerosol-generating system thereby advantageously resulting in the electrically-operated aerosol-generating system having a lower weight and smaller dimensions.

Advantageously, the homogenised botanical material has a pH greater than or equal to about 6.0.

The homogenised botanical material may have a pH of greater than or equal to about 6.5.

Advantageously, the homogenised botanical material has a pH less than or equal to about 8.0.

Use of a homogenised tobacco material comprising tobacco, an aerosol former and a basic pH modifier wherein the homogenised tobacco material has a pH of less than or equal to about 8.0 may advantageously results in lower losses of nicotine during production of the homogenised tobacco material compared to a homogenised tobacco material having a higher pH.

More advantageously, the homogenised botanical material has a pH less than or equal to about 7.5.

The homogenised botanical material may have a pH of less than or equal to about 7.0.

The homogenised botanical material may have a pH of between about 5.5 and about 8.0, between about 5.5 and about 7.5 or between about 5.5 and about 7.0.

The homogenised botanical material may have a pH of between about 6.0 and about 8.0, between about 6.0 and about 7.5 or between about 6.0 and about 7.0.

The homogenised botanical material may have a pH of between about 6.5 and about 8.0, between about 6.5 and about 7.5 or between about 6.5 and about 7.0.

The pH of the homogenised botanical material is measured by dispersing a 0.5 g sample of the homogenised botanical material in 5 g of water, agitating the dispersion and then measuring the pH of the dispersion using a pH electrode.

The homogenised botanical material may have a plant material content of less than or equal to about 90% by weight on a dry weight basis.

The homogenised botanical material may have a plant material content of less than or equal to about 85% by weight on a dry weight basis or less than or equal to about 80% by weight on a dry weight basis.

The homogenised botanical material may advantageously have a plant material content of greater than or equal to about 60% by weight on a dry weight basis.

The homogenised botanical material may have a plant material content of greater than or equal to about 65% by weight on a dry weight basis or greater than or equal to about 70% by weight on a dry weight basis.

The homogenised botanical material may have a plant material content of between about 60% and about 90% by weight on a dry weight basis, between about 60% and about 85% by weight on a dry weight basis or between about 60% and about 80% by weight on a dry weight basis.

The homogenised botanical material may have a plant material content of between about 65% and about 90% by weight on a dry weight basis, between about 65% and about 85% by weight on a dry weight basis or between about 65% and about 80% by weight on a dry weight basis.

The homogenised botanical material may have a plant material content of between about 70% and about 90% by weight on a dry weight basis, between about 70% and about 85% by weight on a dry weight basis or between about 70% and about 80% by weight on a dry weight basis.

Where the homogenised botanical material is a homogenised tobacco material and the plant material is tobacco, the homogenised tobacco material may have a tobacco content of less than or equal to about 90% by weight on a dry weight basis.

The homogenised tobacco material may have a tobacco content of less than or equal to about 85% by weight on a dry weight basis or less than or equal to about 80% by weight on a dry weight basis.

The homogenised tobacco material may have a tobacco content of greater than or equal to about 60% by weight on a dry weight basis.

The homogenised tobacco material may have a tobacco content of greater than or equal to about 65% by weight on a dry weight basis or greater than or equal to about 70% by weight on a dry weight basis.

The homogenised tobacco material may have a tobacco content of between about 60% and about 90% by weight on a dry weight basis, between about 60% and about 85% by weight on a dry weight basis or between about 60% and about 80% by weight on a dry weight basis.

The homogenised tobacco material may have a tobacco content of between about 65% and about 90% by weight on a dry weight basis, between about 65% and about 85% by weight on a dry weight basis or between about 65% and about 80% by weight on a dry weight basis.

The homogenised tobacco material may have a tobacco content of between about 70% and about 90% by weight on a dry weight basis, between about 70% and about 85% by weight on a dry weight basis or between about 70% and about 80% by weight on a dry weight basis.

The aerosol-generating substrate may comprise greater than or equal to about 30% by weight of the homogenised botanical material based on the total weight of the aerosol-generating substrate.

Advantageously, the aerosol-generating substrate comprises greater than or equal to about 40% by weight of the homogenised botanical material based on the total weight of the aerosol-generating substrate More advantageously, the aerosol-generating substrate comprises greater than or equal to about 50% by weight of the homogenised botanical material based on the total weight of the aerosol-generating substrate The aerosol-generating substrate may comprise greater than or equal to about 60% by weight of the homogenised botanical material based on the total weight of the aerosol-generating substrate, greater than or equal to about 70% by weight of the homogenised botanical material based on the total weight of the aerosol-generating substrate, greater than or equal to about 80% by weight of the homogenised botanical material based on the total weight of the aerosol-generating substrate or greater than or equal to about 90% by weight of the homogenised botanical material based on the total weight of the aerosol-generating substrate.

Heated aerosol-generating articles comprising an aerosol-generating substrate comprising a homogenised tobacco material typically have a lower total nicotine content than conventional lit-end cigarettes.

Where the homogenised botanical material is a homogenised tobacco material and the plant material is tobacco, the heated aerosol-generating article may advantageously have a total nicotine content of less than or equal to about 10 mg.

The heated aerosol-generating article may have a total nicotine content of less than or equal to about 8 mg, less than or equal to about 6 mg or less than or equal to about 4 mg.

The homogenised botanical material comprises a basic pH modifier.

The basic pH modifier may advantageously comprise one or more basic inorganic salts selected from the group consisting of alkali metal carbonates, alkaline earth metal carbonates, alkali metal hydrogen carbonates, alkaline earth metal hydrogen carbonates, alkali metal hydroxides, alkaline earth metal hydroxides, alkali metal phosphates, alkaline earth metal phosphates, alkali metal phosphates, alkaline earth metal phosphates, alkali metal monohydrogen phosphates and alkaline earth metal monohydrogen phosphates.

Suitable basic pH modifiers include, but are not limited to, sodium carbonate, potassium carbonate, magnesium carbonate, calcium carbonate, sodium hydrogen carbonate, potassium hydrogen carbonate, magnesium hydrogen carbonate, calcium hydrogen carbonate, sodium hydroxide, potassium hydroxide, magnesium hydroxide, calcium hydroxide, sodium phosphate, potassium phosphate, magnesium phosphate, calcium phosphate, sodium monohydrogen phosphate, potassium monohydrogen phosphate, magnesium monohydrogen phosphate and calcium monohydrogen phosphate.

The basic pH modifier may have a solubility in water of less than or equal to about 0.1 g/100 mL water at 20° C. and 1 atm or less than or equal to about 0.001 g/100 mL water at 20° C. and 1 atm.

Where the homogenised botanical material is a homogenised tobacco material and the plant material is tobacco, inclusion of a basic pH modifier having a solubility in water of less than or equal to about 0.1 g/100 mL water at 20° C.

and 1 atm in the homogenised tobacco material may advantageously result in lower losses of nicotine during production of the homogenised tobacco material compared to a homogenised tobacco material including a basic pH modifier having a higher solubility in water.

The basic pH modifier may have a solubility in water of less than or equal to about 0.05 g/100 mL water at 20° C. and 1 atm or less than or equal to about 0.001 g/100 mL water at 20° C. and 1 atm.

The basic pH modifier may comprise one or more basic inorganic salts selected from the group consisting of alkaline earth metal carbonates, alkaline earth metal hydrogen carbonates, alkaline earth metal hydroxides, alkaline earth metal phosphates and alkaline earth metal monohydrogen phosphates.

For example, the basic pH modifier may comprise magnesium carbonate, calcium carbonate, magnesium hydrogen carbonate, magnesium hydroxide, magnesium phosphate, calcium phosphate or calcium monohydrogen phosphate.

The homogenised botanical material may be formed by agglomerating particulate plant material obtained by grinding or otherwise comminuting one or both of plant leaf lamina and plant leaf stems.

Where the homogenised botanical material is a homogenised tobacco material and the plant material is tobacco, the homogenised tobacco material may comprise one or more of tobacco dust, tobacco fines and other particulate tobacco by-products formed during the treating, handling and shipping of tobacco.

Advantageously, the homogenised tobacco material comprises tobacco powder.

More advantageously, the homogenised tobacco material comprises tobacco powder having an average particle size of between about 0.03 mm and about 0.12 mm.

For example, the homogenised tobacco material may comprise tobacco powder having an average particle size of between about 0.05 mm and about 0.10 mm.

It is believed that grinding or otherwise comminuting tobacco to produce tobacco powder having an average particle size of between about 0.03 mm and about 0.12 mm can open the tobacco cell structure. This may advantageously improve aerosolisation of volatile components, such as nicotine, from the tobacco.

The homogenised botanical material comprises an aerosol former.

The aerosol former may be any suitable known compound or mixture of compounds that, in use, facilitates formation of a dense and stable aerosol and is substantially resistant to thermal degradation at the operating temperature of a heated aerosol-generating article comprising an aerosol-generating substrate comprising the homogenised botanical material.

The aerosol former may help to convey other components of the homogenised botanical material in an aerosol when the homogenised botanical material is heated above the vaporisation temperature of the aerosol former. For example, where the homogenised botanical material is a homogenised tobacco material and the plant material is tobacco, the aerosol former may help to convey other components of the homogenised tobacco material, such as nicotine and flavours, in an aerosol when the homogenised tobacco material is heated above the vaporisation temperature of the aerosol former.

The aerosol former may also help to maintain a desired level of moisture in the homogenised botanical material. For example, the aerosol former may be a hygroscopic material that functions as a humectant.

Suitable aerosol formers are known in the art and include, but are not limited to: monohydric alcohols, such as menthol; polyhydric alcohols, such as triethylene glycol, tetraethylene glycol, 1,3-butanediol, erythritol, propylene glycol and glycerol; esters of polyhydric alcohols, such as glycerol mono-, di- or triacetate and; aliphatic esters of mono-, di- or polycarboxylic acids, such as diethyl suberate, dimethyl dodecanedioate, dimethyl tetradecanedioate, ethyl laurate, lauryl acetate and triethyl citrate; benzyl benzoate; benzyl phenyl acetate; ethyl vanillate; lauric acid; myristic acid; propylene carbonate; and tributyrin.

The homogenised botanical material may advantageously have an aerosol former content of greater than or equal to about 5% by weight on a dry weight basis.

The homogenised botanical material may have an aerosol former content of greater than or equal to about 10% by weight on a dry weight basis or greater than or equal to about 15% by weight on a dry weight basis.

The homogenised botanical material may advantageously have an aerosol former content of less than or equal to about 35% by weight on a dry weight basis.

The homogenised botanical material may have an aerosol former content of less than or equal to about 30% by weight on a dry weight basis, less than or equal to about 25% by weight on a dry weight basis or less than or equal to about 20% by weight on a dry weight basis.

The homogenised botanical material may have an aerosol former content of between about 5% and about 35% by weight on a dry weight basis, between about 5% and about 30% by weight on a dry weight basis, between about 5% and about 25% by weight on a dry weight basis or between about 5% and about 20% by weight on a dry weight basis.

The homogenised botanical material may have an aerosol former content of between about 10% and about 35% by weight on a dry weight basis, between about 10% and about 30% by weight on a dry weight basis, between about 10% and about 25% by weight on a dry weight basis or between about 10% and about 20% by weight on a dry weight basis.

The homogenised botanical material may have an aerosol former content of between about 15% and about 35% by weight on a dry weight basis, between about 15% and about 30% by weight on a dry weight basis, between about 15% and about 25% by weight on a dry weight basis or between about 15% and about 20% by weight on a dry weight basis.

The homogenised botanical material may advantageously further comprise a binder.

The inclusion of a binder may advantageously increase the strength of the homogenised botanical material. This may advantageously facilitate manufacture of a sheet of the homogenised botanical material.

Inclusion of a binder may advantageously improve the homogeneity of a sheet of the homogenised botanical material compared to a sheet in which no binder is included.

Suitable binders are known in the art and include, but are not limited to: alginates; celluloses, such as methyl cellulose, ethyl cellulose, ethyl hydroxyethyl cellulose and carboxymethyl cellulose; dextrans; gums; gum derivatives, such as hydroxyethyl guar gum, hydroxypropyl guar gum, hydroxyethyl locust bean gum and hydroxypropyl locust bean gum; pectins, such as fruit pectins, citrus pectins and tobacco pectins; starches, such as modified or derivatised starches; pullulan; and konjac flour.

The homogenised botanical material may comprise a gum binder.

Advantageously, the homogenised botanical material may comprise a natural gum binder.

More advantageously, the homogenised botanical material may comprise one or more natural gum binders selected from the group consisting of gum arabic, guar gum, locust bean gum, tamarind gum and xanthan gum.

The homogenised botanical material may comprise two or more different binders.

Advantageously, the homogenised botanical material may have a binder content of greater than or equal to about 1% by weight on a dry weight basis.

The homogenised botanical material may have a binder content of greater than or equal to about 2% by weight on a dry weight basis.

Advantageously, the homogenised botanical material may a have a binder content of less than or equal to about 10% by weight on a dry weight basis.

The homogenised botanical material may have a binder content of less than or equal to about 8% by weight on a dry weight basis, less than or equal to about 6% by weight on a dry weight basis or less than or equal to about 4% by weight on a dry weight basis.

The homogenised botanical material may have a binder content of between about 1% and about 10% by weight on a dry weight basis, between about 1% and about 8% by weight on a dry weight basis, between about 1% and about 6% by weight on a dry weight basis or between about 1% and about 4% by weight on a dry weight basis.

The homogenised botanical material may have a binder content of between about 2% and about 10% by weight on a dry weight basis, between about 2% and about 8% by weight on a dry weight basis, between about 2% and about 6% by weight on a dry weight basis or between about 2% and about 4% by weight on a dry weight basis.

The homogenised botanical material may advantageously further comprise a lipid.

Inclusion of a lipid may advantageously enhance diffusivity of volatile components within the homogenised botanical material and hence transfer of volatile components from the homogenised botanical material to an aerosol upon heating of the homogenised botanical material to a temperature above the melting point of the lipid compared to a homogenised botanical material in which no lipid is included.

The lipid may advantageously have a melting point of between about 50° C. and about 150° C.

The lipid may be a wax.

The lipid may be a natural wax of vegetable origin.

The homogenised botanical material may comprise one or more waxes selected from the group consisting of candelilla wax, carnauba wax, shellac, sunflower wax, rice bran wax and Revel A.

Advantageously, the lipid is selected from the group consisting of: fully saturated triglycerides, such as fully hydrogenated vegetable oils; saturated fatty acids, such as palmitic acid; alkali metal salts of saturated fatty acids, such as sodium stearate; and alkaline earth metal salts of saturated fatty acids.

The homogenised botanical material may comprise two or more different lipids having the same or different melting points.

Advantageously, the homogenised botanical material may have a lipid content of greater than or equal to about 1% by weight on a dry weight basis.

The homogenised botanical material may have a lipid content of greater than or equal to 2% by weight on a dry weight basis.

Advantageously, the homogenised botanical material may a have a lipid content of less than or equal to about 10% by weight on a dry weight basis.

The homogenised botanical material may have a lipid content of less than or equal to about 8% by weight on a dry weight basis or less than about or equal to about 6% by weight on a dry weight basis.

The homogenised botanical material may have a lipid content of between about 1% and about 10% by weight on a dry weight basis, between about 1% and about 8% by weight on a dry weight basis or between about 1% and about 6% by weight on a dry weight basis.

The homogenised botanical material may have a lipid content of between about 2% and about 10% by weight on a dry weight basis, between about 2% and about 8% by weight on a dry weight basis or between about 2% and about 6% by weight on a dry weight basis.

The homogenised botanical material may advantageously further comprise cellulose fibres.

The inclusion of cellulose fibres may advantageously increase the tensile strength of the homogenised botanical material. This may advantageously facilitate manufacture of a sheet of the homogenised botanical material.

The homogenised botanical material may comprise one or both of tobacco cellulose fibres or non-tobacco cellulose fibres.

Suitable non-tobacco cellulose fibres for inclusion in the homogenised botanical material are known in the art and include, but are not limited to: hardwood fibres; softwood fibres; jute fibres; and flax fibres.

The cellulose fibres may advantageously have an average fibre length of between about 0.2 mm and about 4.0 mm The cellulose fibres may have an average fibre length of between about 1.0 mm and about 3.0 mm The cellulose fibres may be subjected to processes such as mechanical pulping, chemical pulping, sulphate pulping, refining, bleaching and combinations thereof.

The homogenised botanical material may advantageously have a cellulose fibre content of greater than or equal to about 1% by weight on a dry weight basis.

The homogenised botanical material may advantageously have a cellulose fibre content of greater than or equal to about 2% by weight on a dry weight basis or greater than or equal to about 3% by weight on a dry weight basis.

The homogenised botanical material may advantageously have a cellulose fibre content of less than or equal to about 15% by weight on a dry weight basis.

The homogenised botanical material may have a cellulose fibre content of less than or equal to about 10% by weight on a dry weight basis or less than about 5% by weight on a dry weight basis.

The homogenised botanical material may have a cellulose fibre content of between about 1% and about 15% by weight on a dry weight basis, between about 1% and about 10% by weight on a dry weight basis or between about 1% and about 5% by weight on a dry weight basis.

The homogenised botanical material may have a cellulose fibre content of between about 2% and about 15% by weight on a dry weight basis, between about 2% and about 10% by weight on a dry weight basis or between about 2% and about 5% by weight on a dry weight basis.

The homogenised botanical material may have a cellulose fibre content of between about 3% and about 15% by weight on a dry weight basis, between about 3% and about 10% by weight on a dry weight basis or between about 3% and about 5% by weight on a dry weight basis.

The homogenised botanical material may further comprise one or more flavourants.

As used herein with reference to the invention, the term "flavourant" denotes an agent that, in use, imparts one or both of a taste or aroma to an aerosol generated by heating an aerosol-generating substrate comprising the homogenised botanical material.

The homogenised botanical material may further comprise one or more natural flavourants, one or more artificial flavourants or a combination of one or more natural flavourants and one or more artificial flavourants.

For example, the homogenised botanical material may comprise one or more flavourants that provide a flavour selected from the group consisting of menthol, lemon, vanilla, orange, wintergreen, cherry, and cinnamon.

The homogenised botanical material may further comprise one or more chemesthetic agents.

As used herein with reference to the invention, the term "chemesthetic agent" denotes an agent that, in use, is perceived in the oral or olfactory cavities of a user by means other than, or in addition to, perception via taste receptor or olfactory receptor cells. Perception of chemesthetic agents is typically via a 'trigeminal response', either via the trigeminal nerve, glossopharyngeal nerve, the vagus nerve, or some combination of these. Typically, chemesthetic agents are perceived as hot, spicy, cooling, or soothing sensations.

The homogenised botanical material may comprise one or more agents that are both a flavourant and a chemesthetic agent. For example, the homogenised botanical material may comprise menthol or another flavourant that provides a cooling chemesthetic effect.

As used herein with reference to the invention, the term "menthol" denotes the compound 2-isopropyl-5-methylcyclohexanol in any of its isomeric forms.

The homogenised botanical material may be made using suitable known reconstitution processes for producing homogenised tobacco materials including, but are not limited to, paper-making processes, casting or 'cast leaf' processes, dough reconstitution processes and extrusion processes.

Preferably, the homogenised botanical material is made using a casting process.

Preferably, the homogenised botanical material is in the form of a sheet.

More preferably, the homogenised botanical material is in the form of a cast sheet.

Sheets of homogenised botanical material for use in an aerosol-forming substrate of a heated aerosol-generating according to the invention are preferably formed by a casting process of the type generally comprising casting a slurry comprising particulate plant material and one or more binders onto a conveyor belt or other support surface, drying the cast slurry to form a sheet of homogenised botanical material and removing the sheet of homogenised botanical material from the support surface.

The sheet of homogenised botanical material may advantageously have a width of at least about 20 mm.

The sheet of homogenised botanical material may have a width of greater than or equal to about 40 mm, greater than or equal to about 60 mm or greater than or equal to about 80 mm.

The sheet of homogenised botanical material may have a width of between about 20 mm and about 300 mm, between about 40 mm and about 300 mm, between about 60 mm and about 300 mm or between about 80 mm and about 300 mm.

The sheet of homogenised botanical material may advantageously have a thickness of greater than or equal to about 50 microns.

The sheet of homogenised botanical material may have a thickness of greater than or equal to about 75 microns, greater than or equal to about 100 microns or greater than or equal to about 125 microns.

The sheet of homogenised botanical material may have a thickness of between about 50 microns and about 300 microns, between about 75 microns and about 300 microns, between about 100 microns and about 300 microns or between about 125 microns and about 300 microns.

Advantageously, the sheet of homogenised botanical material may be textured. This may facilitate gathering of the sheet of homogenised botanical material to form an aerosol-generating rod.

As used herein with reference to the invention, the term "textured sheet of homogenised botanical material" denotes a sheet of homogenised botanical material that has been crimped, embossed, debossed, perforated or otherwise deformed. Textured sheets of homogenised botanical material may comprise a plurality of spaced-apart indentations, protrusions, perforations or a combination thereof.

More advantageously, the sheet of homogenised botanical material may be crimped.

As used herein with reference to the invention, the term "crimped sheet of homogenised botanical material" is intended to be synonymous with the term "creped sheet of homogenised botanical material" and denotes a sheet of homogenised botanical material having a plurality of substantially parallel ridges or corrugations.

Advantageously, the crimped sheet of homogenised botanical material may have a plurality of ridges or corrugations substantially parallel to the cylindrical axis of the aerosol-generating rod. This may advantageously facilitate gathering of the crimped sheet of homogenised botanical material to form an aerosol-generating rod.

The sheet of homogenised botanical material may be textured using suitable known machinery for texturing filter tow, paper and other materials.

The sheet of homogenised botanical material may be crimped using a crimping unit of the type described in CH-A-691156, which comprises a pair of rotatable crimping rollers. However, it will be appreciated that the sheet may be textured using other suitable machinery and processes that deform or perforate the sheet.

A method of making a cast sheet of homogenised botanical material for use in an aerosol-forming substrate of a heated aerosol-generating according to the invention comprises the steps of: combining plant material, an aerosol former and a basic pH modifier to form a slurry; casting the slurry onto a support surface; drying the cast slurry to form a cast sheet of homogenised botanical material; and removing the cast sheet of homogenised botanical material from the support surface.

The method may advantageously comprise the step of: combining plant material, an aerosol former and a basic pH modifier with water to form an aqueous slurry.

The method may further comprise combining one or more additional components, such as binders, lipids, cellulose fibres, flavourants, chemesthetic agents and combinations thereof, with plant material, an aerosol former and a basic pH modifier to form a slurry.

Where the cast sheet of homogenised botanical material further comprises cellulose fibres, the method may comprise the step of: combining plant material, an aerosol former, a basic pH modifier and loose cellulose fibres to form a slurry.

The combining step may comprise: mixing plant material, an aerosol former and a basic pH modifier and, where included, one or more additional components to form a slurry.

The combining step may be performed using a high energy mixer or a high shear mixer. Use of a high energy mixer or a high shear mixer may advantageously break down and distribute the components forming the slurry evenly within the slurry.

Where the cast sheet of homogenised botanical material further comprises a lipid, the method may further comprise the steps of: heating the slurry to a temperature above the melting point of the lipid; and then cooling the slurry to a temperature below the melting point of the lipid prior to casting the slurry onto a support surface. This may advantageously help to distribute the lipid evenly within the homogenised botanical material.

The method may further comprise the step of: vibrating the slurry prior to casting the slurry onto the support surface. For example, the method may comprise the step of vibrating a tank, silo or other vessel containing the slurry prior to the casting step. Vibrating the slurry prior to the casting step may advantageously help to homogenise the slurry.

The casting step may comprise casting the slurry onto a moving support surface such as a moving belt.

The cast slurry advantageously has a moisture content of between about 60% and about 80% by weight based on the total weight of the cast slurry.

The drying step may comprise drying the cast slurry using steam and heated air.

The drying step may advantageously comprise drying the side of the cast slurry that is in contact with the support with steam and drying the side of the cast slurry that is not in contact with the support with heated air.

The drying step may comprise drying the cast slurry to form a cast sheet of homogenised botanical material having a moisture content of between about 7% and about 15% by weight on a dry weight basis.

The drying step may advantageously comprise drying the cast slurry to form a cast sheet of homogenised botanical material having a moisture content of between about 8% and about 12% by weight on a dry weight basis.

The method may further comprise the step of: winding the cast sheet of homogenised material onto a bobbin after the step of removing the cast sheet of homogenised botanical material form the support surface.

The method may further comprise the steps of: gathering the cast sheet of homogenised botanical material transversely relative to a longitudinal axis thereof; circumscribing the gathered cast sheet of homogenised botanical material with a wrapper to form a rod; and severing the rod into a plurality of discrete aerosol-generating rods.

The method may further comprise the step of: crimping the cast sheet of homogenised botanical material prior to the gathering step.

Advantageously, the heated aerosol-generating article comprises an aerosol-generating rod comprising a gathered sheet of the homogenised botanical material circumscribed by a wrapper.

More advantageously, the heated aerosol-generating article comprises an aerosol-generating rod comprising a gathered cast sheet of the homogenised botanical material circumscribed by a wrapper.

The aerosol-generating rod may be produced using conventional cigarette filter making machinery.

For example, the aerosol-generating rod comprising a gathered sheet of the homogenised botanical material circumscribed by a wrapper may be produced using machinery for forming filter rods comprising a gathered crimped sheet of paper of the type described in CH-A-691156.

The gathered sheet of homogenised botanical material advantageously extends along substantially the entire length of the aerosol-generating rod and across substantially the entire transverse cross-sectional area of the aerosol-generating rod.

Advantageously, the aerosol-generating rod may be of substantially uniform cross-section.

The aerosol-generating rod may advantageously have a rod length of between about 5 mm and about 25 mm, between about 5 mm and about 20 mm or between about 5 mm and about 15 mm.

As used herein with reference to the invention, the term "rod length" denotes the maximum dimension in the direction of the cylindrical axis of the aerosol-generating rod.

The aerosol-generating rod may advantageously have a rod diameter of between about 6 mm and about 10 mm, between about 6 mm and about 9 mm or between about 6 mm and about 8 mm.

As used herein with reference to the invention, the term "rod diameter" denotes the maximum dimension in a direction substantially perpendicular to the cylindrical axis of the aerosol-generating rod.

The aerosol-generating rod may comprise a gathered sheet of the homogenised botanical material circumscribed by a porous wrapper.

The aerosol-generating rod may comprise a gathered sheet of the homogenised botanical material circumscribed by a non-porous wrapper.

A method of forming the aerosol-generating rod may comprise the steps of: providing a continuous sheet of homogenised botanical material comprising plant material, an aerosol former and a basic pH modifier, wherein the homogenised botanical material has a pH greater than or equal to about 5.5; gathering the continuous sheet transversely relative to the longitudinal axis thereof; circumscribing the gathered continuous sheet with a wrapper to form a continuous rod; and severing the continuous rod into a plurality of discrete aerosol-generating rods.

The aerosol-generating rod may advantageously be used in a heated aerosol-generating article.

An inhalable nicotine-containing aerosol is generated upon heating of the aerosol-generating rod.

A number of aerosol-generating articles in which an aerosol-generating substrate is heated rather than combusted have been proposed in the art. Typically in heated aerosol-generating articles, an aerosol is generated by the transfer of heat from a heat source, for example a chemical, electrical or combustible heat source, to a physically separate aerosol-generating substrate, which may be located within, around or downstream of the heat source.

The aerosol-generating rod may be used in a heated aerosol-generating article comprising a combustible heat source and an aerosol-generating substrate downstream of the combustible heat source.

For example, the aerosol-generating rod may be used in an aerosol-generating article of the type disclosed in WO 2009/022232 A2 which comprises a combustible carbonaceous heat source, an aerosol-generating substrate downstream of the combustible heat source and a heat-conducting element around and in contact with a rear portion of the combustible carbonaceous heat source and an adjacent front portion of the aerosol-generating substrate. It will be appreciated that the aerosol-generating rod may also be used in heated aerosol-generating articles comprising combustible heat sources having other constructions.

The aerosol-generating rod may advantageously be used in a heated aerosol-generating article for use in an electrically-operated aerosol-generating system in which the aerosol-generating substrate of the heated aerosol-generating article is heated by an electrical heat source.

For example, the aerosol-generating rod may be used in a heated aerosol-generating article of the type disclosed in EP 0 822 760 A2.

Heated aerosol-generating articles according to the invention may comprise: an aerosol-generating rod; and one or more other components.

The one or more other components may include one or more of a support element, a spacer element, an aerosol-cooling element and a mouthpiece.

The aerosol-generating rod and one or more other components may be assembled within a wrapper of the heated aerosol-generating article to form an elongate rod having a mouth end and a distal end upstream from the mouth end. The heated aerosol-generating article may thus resemble a conventional lit-end cigarette.

EXAMPLE

Cast sheets of homogenised tobacco material are prepared having the compositions shown in Table 1, where the values shown are the percentages by weight on a dry weight basis:

TABLE 1

| Component | Sample 1 (reference) | Sample 2 | Sample 3 |
|---|---|---|---|
| Tobacco powder | 75 | 65 | 74.08 |
| Glycerol (aerosol former) | 20 | 20 | 20 |
| Guar gum (binder) | 3 | 3 | 3 |
| Cellulose fibres | 2 | 2 | 2 |
| Basic pH modifier | 0 | 10 (calcium carbonate) | 0.92 (calcium hydroxide) |

| Component | Sample 4 | Sample 5 | Sample 6 |
|---|---|---|---|
| Tobacco powder | 73.15 | 73.55 | 72.83 |
| Glycerol (aerosol former) | 10 | 10 | 10 |
| Guar gum (binder) | 3 | 3 | 3 |
| Cellulose fibres | 2 | 2 | 2 |
| Lipid (fully-hydrogenated palm oil) | 0 | 10 | 10 |
| Basic pH modifier | 1.85 (calcium hydroxide) | 1.45 (magnesium hydroxide) | 2.17 (magnesium hydroxide) |

To prepare the cast sheet of homogenised tobacco material of sample 1, the tobacco powder, glycerol, guar gum and cellulose fibres are combined with water to produce an aqueous slurry. The aqueous slurry is cast onto a support surface and then dried to form the cast sheet of homogenised tobacco material of sample 1.

To prepare the cast sheets of homogenised tobacco material of samples 2, 3 and 4, the tobacco powder, glycerol, guar gum, cellulose fibres and basic pH modifier are combined with water to produce an aqueous slurry. The aqueous slurry is cast onto a support surface and then dried to form the cast sheets of homogenised tobacco material of samples 2, 3 and 4.

To prepare the cast sheets of homogenised tobacco material of samples 5 and 6, the tobacco powder, glycerol, guar gum, cellulose fibres, lipid and basic pH modifier are combined with water to produce an aqueous slurry. The aqueous slurry is cast onto a support surface and then dried to form the cast sheets of homogenised tobacco material of samples 5 and 6.

The pH of the aqueous slurries used to form the cast sheets of homogenised tobacco material of samples 1 to 6 measured using a pH electrode.

The pH of the cast sheets of homogenised tobacco material of samples 1 to 6 is measured by dispersing 5 g of the cast sheet of homogenised tobacco material in 5 g of water and measuring the pH of the dispersion using a pH electrode.

The pH values obtained are shown in Table 2 below.

The nicotine content of methanoic extracts of samples of the cast sheets of homogenised tobacco material of samples 1 to 6 is measured using a gas chromatography flame ionization detector (GC-FID).

The cast sheets of homogenised tobacco material of samples 1 to 6 are gathered and circumscribed by a wrapper to form aerosol-generating rods. Heated aerosol-generating articles for use in an electrically-operated aerosol-generating system are formed comprising aerosol-generating substrates comprising the aerosol-generating rods.

The nicotine content of aerosols generated by electrically heating the heated aerosol-generating articles to a maximum temperature of 350° C. under Health Canada smoking conditions is determined using GC-FID. The nicotine transfer yields of the heated aerosol-generating articles are calculated from the nicotine content of the aerosols, the nicotine content of the cast sheets of homogenised tobacco material and the quantity of homogenised tobacco material in the aerosol-generating substrate of the heated aerosol-generating articles. The nicotine transfer yield is defined as (amount of nicotine delivered in the aerosol upon heating)/(amount of nicotine in the gathered cast sheet of homogenised tobacco material in the aerosol-generating substrate of the aerosol-generating article before heating). The results are shown in the Table 2 below:

TABLE 2

| Sample | pH of cast sheet of homogenised tobacco material | pH of aqueous slurry | Nicotine loss during preparation of cast sheet of homogenised tobacco material* | Increase of nicotine transfer yield* |
|---|---|---|---|---|
| 1 (reference) | 5.30 | 5.02 | — | — |
| 2 | 5.60 | 5.23 | 3.4% | 8% |
| 3 | 6.05 | 6.24 | 0.3 | 5% |
| 4 | 6.39 | 7.65 | 11.1% | 15% |
| 5 | 6.76 | 6.91 | 11.2% | 43% |
| 6 | 7.28 | 7.57 | 12.2% | 38% |

*relative to sample 1

As shown in Table 2, inclusion of a basic pH modifier in the cast sheets of homogenised tobacco material of samples 2 to 6 increases the pH of the cast sheets of homogenised tobacco material of samples 2 to 6 to between 5.5 and 8. As shown in Table 2, this advantageously significantly increases the nicotine transfer yield of the heated aerosol-generating articles comprising the cast sheets of homogenised tobacco material of samples 2 to 6 compared to the heated aerosol-generating article comprising the cast sheet of homogenised tobacco material of reference sample 1, which does not include a basic pH modifier and which has a pH of less than 5.5.

Increasing the pH of the cast sheets of homogenised tobacco material of samples 2 to 6 to between 5.5 and 8 also increases the nicotine loss during preparation of the cast sheet of homogenised tobacco material of samples 2 to 6 compared to the cast sheet of homogenised tobacco material of reference sample 1, which does not include a basic pH modifier. However, the increase in nicotine transfer yield of the heated aerosol-generating articles comprising the cast sheets of homogenised tobacco material of samples 2 to 6 outweighs the increase in nicotine loss during preparation of the cast sheet of homogenised tobacco material of samples 2 to 6. This advantageously leads to overall increased aerosol levels of nicotine for the heated aerosol-generating articles comprising the cast sheets of homogenised tobacco material of samples 2 to 6 compared to the heated aerosol-generating article comprising the cast sheet of homogenised tobacco material of reference sample 1.

As shown in Table 2, inclusion of a lipid in the cast sheets of homogenised tobacco material of samples 5 and 6, advantageously further increases the nicotine transfer yield of the heated aerosol-generating articles comprising the cast sheets of homogenised tobacco material of samples 5 and 6 compared to the heated aerosol-generating articles comprising the cast sheets of homogenised tobacco material of samples 2 to 4, which do not include a lipid.

The specific embodiments described above are intended to illustrate the invention. However, other embodiments may be made without departing from the scope of the invention as defined in the claims and it is to be understood that the specific embodiments described above are not intended to be limiting.

The invention claimed is:

1. A heatable aerosol-generating article, comprising:

an aerosol-generating substrate, the aerosol-generating substrate comprising a sheet of homogenised tobacco material comprising particulate tobacco material having an average particle size of between 0.03 mm and 0.12 mm, an aerosol former, and a basic pH modifier, wherein the homogenised tobacco material has a particulate tobacco material content of greater than or equal to about 60% by weight on a dry weight basis and less than or equal to about 90% by weight on a dry weight basis, wherein the homogenised tobacco material has a pH greater than or equal to about 6.0 and less than or equal to about 7.5, wherein the basic pH modifier is magnesium hydroxide and/or calcium hydroxide, wherein the homogenized tobacco material further comprises a lipid selected from the group consisting of a fully saturated triglyceride, an alkali metal salt of a saturated fatty acid, and alkaline earth metal salts of saturated fatty acids, and wherein the lipid content is between about 1% and about 10% on a dry weight basis.

2. The heatable aerosol-generating article according to claim 1, wherein the heatable aerosol-generating article has a total nicotine content of less than or equal to about 10 mg.

3. The heatable aerosol-generating article according to claim 1, wherein the basic pH modifier further comprises one or more basic inorganic salts selected from the group consisting of alkali metal carbonates, alkaline earth metal carbonates, alkali metal hydrogen carbonates, alkaline earth metal hydrogen carbonates, alkali metal hydroxides, alkaline earth metal hydroxides, alkali metal phosphates, alkaline earth metal phosphates, alkali metal phosphates, alkaline earth metal phosphates, alkali metal monohydrogen phosphates, and alkaline earth metal monohydrogen phosphates.

4. The heatable aerosol-generating article according to claim 1, wherein the basic pH modifier has a solubility in water of less than about 0.1 g/100 mL water at 20° C. and 1 atm.

5. The heatable aerosol-generating article according to claim 1, wherein the homogenised tobacco material has an aerosol former content of between about 5% and about 25% by weight on a dry weight basis.

6. The heatable aerosol-generating article according to claim 1, further comprising an aerosol-generating rod comprising a gathered sheet of the homogenised tobacco material circumscribed by a wrapper.

7. The heatable aerosol-generating article according to claim 6, wherein the aerosol-generating rod further comprises a gathered cast sheet of the homogenised tobacco material circumscribed by a wrapper.

8. An electrically-operated aerosol-generating system comprising the heatable aerosol-generating article according to claim 1.

9. The heatable aerosol-generating article according to claim 1, further comprising a combustible heat source, wherein the aerosol-generating substrate is disposed downstream of the combustible heat source.

10. The heatable aerosol-generating article according to claim 6, wherein the gathered sheet of homogenised tobacco material extends along an entire length of the aerosol-generating rod and across an entire transverse cross-sectional area of the aerosol-generating rod.

11. The heatable aerosol-generating article according to claim 1, wherein the basic pH modifier further comprises magnesium carbonate, calcium carbonate, magnesium hydrogen carbonate, magnesium phosphate, calcium phosphate, or calcium monohydrogen phosphate.

12. The heatable aerosol-generating article according to claim 1, wherein the homogenized tobacco material has a nicotine transfer yield that is at least about 15% higher than the transfer yield of a reference homogenized tobacco material that does not comprise a basic pH modifier.

* * * * *